US011174053B2

(12) United States Patent
Sjölander et al.

(10) Patent No.: US 11,174,053 B2
(45) Date of Patent: Nov. 16, 2021

(54) FILLING MACHINE FOR FILLING OF A FLEXIBLE POUCH TYPE PACKAGE

(71) Applicant: Ecolean AB, Helsingborg (SE)

(72) Inventors: Thomas Sjölander, Allerum (SE); Carl-Magnus Källberg, Ödåkra (SE); Rickard Lavesson, Jonstorp (SE); Torbjörn Pålsson, Genarp (SE)

(73) Assignee: ECOLEAN AB, Helsingborg (SE)

( * ) Notice: Subject to any disclaimer, the term of this patent is extended or adjusted under 35 U.S.C. 154(b) by 168 days.

(21) Appl. No.: 16/487,903

(22) PCT Filed: Feb. 14, 2018

(86) PCT No.: PCT/EP2018/053653
§ 371 (c)(1),
(2) Date: Aug. 22, 2019

(87) PCT Pub. No.: WO2018/153742
PCT Pub. Date: Aug. 30, 2018

(65) Prior Publication Data

US 2020/0231317 A1 Jul. 23, 2020

(30) Foreign Application Priority Data

Feb. 22, 2017 (EP) ..... 17157299

(51) Int. Cl.
*B65B 43/30* (2006.01)
*B65B 43/46* (2006.01)
(Continued)

(52) U.S. Cl.
CPC ..... *B65B 43/30* (2013.01); *B65B 43/465* (2013.01); *B65B 43/123* (2013.01); *B65B 43/18* (2013.01); *B65B 43/36* (2013.01); *B65B 51/146* (2013.01)

(58) Field of Classification Search
CPC ..... B65B 43/123; B65B 43/16; B65B 43/18; B65B 43/30; B65B 43/36; B65B 43/465; B65B 51/146
(Continued)

(56) References Cited

U.S. PATENT DOCUMENTS 4,914,895 A * 4/1990 Kuckhermann ..... B65B 43/465 53/386.1
5,179,816 A * 1/1993 Wojnicki ..... B65B 43/30 53/570
(Continued)

FOREIGN PATENT DOCUMENTS

EP 2174872 A1 4/2010
EP 3067282 A1 9/2016
(Continued)

OTHER PUBLICATIONS

International Search Report PCT/EP2018/053653 dated Mar. 23, 2018.

*Primary Examiner* — Stephen F. Gerrity
(74) *Attorney, Agent, or Firm* — Brundidge & Stanger, P.C.

(57) ABSTRACT

A filling machine for filling flexible pouch type packages that includes a transport unit arranged for intermittent, edgewise advancement of the packages from an upstream station to a downstream station. The transport unit is movable in a reciprocating manner between a first end position and a second end position, and includes a first gripping member arranged to retrieve packages from the upstream station and delivered to the filling station, a second gripping member arranged to retrieve packages from the filling station and delivered to the downstream station and a suction cup member arranged for opening the filling channel of the packages retrieved by the first gripping member. The suction cup member includes, for each package retrieved by the first
(Continued)

gripping member, a pair of oppositely arranged suction cups movably arranged in order to engage and separate side wall sections defining the filling channel of the associated package.

8 Claims, 5 Drawing Sheets

(51) Int. Cl.
*B65B 43/12* (2006.01)
*B65B 43/18* (2006.01)
*B65B 43/36* (2006.01)
*B65B 51/14* (2006.01)

(58) Field of Classification Search
USPC ..... 53/570, 250, 386.1
See application file for complete search history.

(56) References Cited

U.S. PATENT DOCUMENTS 7,100,658 B2 * 9/2006 Amigo ..... B65B 43/465
53/570
2011/0107730 A1 5/2011 Mikael

FOREIGN PATENT DOCUMENTS

FR 3030460 A1 * 6/2016 ..... B65B 43/465
JP 04294726 A * 10/1992 ..... 53/570

* cited by examiner

FILLING MACHINE FOR FILLING OF A FLEXIBLE POUCH TYPE PACKAGE

CROSS-REFERENCE TO RELATED APPLICATION

This Application is the National Stage filing under 35 U.S.C. § 371 of PCT Application Ser. No. PCT/EP2018/053653 filed on Feb. 14, 2018, which claims the benefit of European Patent Application No. 17157299.3 filed on Feb. 22, 2017. The disclosures of both applications are hereby incorporated herein by reference in their entireties.

FIELD OF THE INVENTION

The present invention relates to a filling machine and more specifically to a filling machine for filling of flexible pouch type packages each having a filling channel and being essentially flat in a non-filled state of the package.

BACKGROUND ART

Many different types of packages for liquid contents are currently available.

One type of package is of pouch type and comprises two side walls which are flexible and joined along a connecting portion to form a compartment, whose volume is dependent on the relative position of the walls. The pouch type package may be of stand-up pouch type and may then also comprise a bottom wall.

This type of packages may be used as a pre-made package in a filling machine. Before filling, the package may be in a flat and sealed state. This makes it possible to sterilise the compartment of the packages in connection with manufacture and, with maintained sterility, distribute the packages to a filling plant, such as a dairy, to be filled.

The pre-made pouch type package may be filled in a filling machine arranged for edgewise advancement of the package through the filling machine, i.e. the package is moved in the plane in which the non-filled essentially flat package extends.

The different operations of the filling machine, e.g. advancement of packages, opening-up of filling channels of the package, filling, sealing, must all be performed at high speed if the filling machine is to operate at high speed and bottleneck effects are to be avoided.

SUMMARY OF THE INVENTION

In view of that stated above, the object of the present invention is to provide an improved filling machine for filling of flexible pouch type packages.

It is also an object to provide such a filling machine with improved production capacity.

To achieve at least one of the above objects and also other objects that will be evident from the following description, a filling machine having the features defined in claim 1 is provided according to the present invention. Preferred embodiments of the filling machine will be evident from the dependent claims.

More specifically, there is provided according to the present invention a filling machine for filling of flexible pouch type packages each having a filling channel and being essentially flat in a non-filled state of the package. The filling machine comprises a transport unit arranged for intermittent, edgewise advancement of the packages in a feeding direction from an upstream station to a downstream station via a filling station. The transport unit is movable along an axis parallel with the feeding direction in a reciprocating manner between a first end position and a second end position. The transport unit comprises a first gripping member which, when the transport unit is in the first end position, is arranged to retrieve one or more of the packages in a non-filled state from the upstream station and which, when the transport unit is in the second end position, is arranged to deliver the one or more of the packages in the non-filled state to the filling station. The transport unit comprises a second gripping member which, when the transport unit is in the first end position, is arranged to retrieve one or more of the packages in a filled state from the filling station and which, when the transport unit is in the second end position, is arranged to deliver the one or more of the packages in the filled state to the downstream station. The transport unit comprises a suction cup member arranged for opening-up of the filling channel of the one or more of the packages in the non-filled state retrieved by the first gripping member while the transport unit is moved from the first end position to the second end position, wherein the suction cup member for each package retrieved by the first gripping member comprises a pair of oppositely arranged suction cups which are movably arranged in order to engage and separate side wall sections defining the filling channel of the associated package.

The term "edgewise advancement" of the package should be construed as movement of the package in a direction coinciding with the plane in which the package in an essentially flat, non-filled state extends.

The transport unit of the inventive filling machine thus allows for simultaneous movement of one or packages from the upstream station and the filling station to the filling station and the downstream station, respectively. Thus, groups of packages may be intermittently, edgewise advanced through the filling machine, from one station to the next.

The filling machine may naturally be provided with stationary grippers arranged for handing over the packages when these are retrieved by the first and second gripping members of the transport unit and for taking hold of the packages delivered by the first and second gripping members of the transport unit.

The transport unit of the inventive filling machine comprises a suction cup member arranged to open-up the filling channels of the packages as these are moved from the upstream station to the filling station. As a result, the packages arriving to the filling station are in a state ready to be filled. The fact that the filling channels of the packages are opened-up during movement from the upstream station to the filling station makes it possible to reduce the time the packages are held stationary at the respective station, and thus the production capacity of the filling machine may be improved. The step of inserting filling pipes of the filling station into the filling channels of the packages may thus not have to await the step of opening-up of the filling channels.

Each suction cup of the suction cup member may have an axis which is tilted with an angle in the range of 1-10 degrees relative a horizontal plane. The axis may be tilted such that an engagement surface of the suction cup is faced obliquely upward. Hereby separation of the side wall sections defining the filling channels of the packages may be more easily separated when the opposing pairs of suction cups are separated in order to open-up the filling channels.

The filling machine may further comprise a cam arrangement comprising a first cam unit associated with the first and second gripping member, a second cam unit associated with the suction cup member, and a cam driver which is displaceable along a longitudinal axis parallel with the feeding direction, wherein the operation of the first and second gripping member as well as of the suction cup member is controlled by displacement of the cam driver along the longitudinal axis. The use of a cam arrangement having a cam driver cooperating with the first cam unit controlling the first and second gripping members as well with the second cam unit controlling the suction cup member enables synchronized and precise operation.

The cam driver may displaceable by means of linear actuator comprising a servomotor. The use of a servomotor enables precise operation at high speed.

Each of the first and second gripping member of the transport unit may be arranged for parallel handling of a group of packages consisting of 2-6 packages. Parallel handling of several packages by each of the first and second gripping member enables an improved production capacity.

The suction cups of the suction cup member may be arranged to engage the one or more packages at a distance D in the range of 2-10 mm from a top edge of the packages. By engaging the packages by the suction cup member at a distance from the top edge, it may be ensured that the top edge portion of each packages is accessible by other means, such as a clamping jaw unit for ensuring leakage free filling at the filling station, or a sealing jaw unit at a sealing station, which may be integrated in the filling station.

The first and second gripping members may be arranged at a level separate from a level at which the suction cup member is arranged. Hereby it may be ensured that the operation of the first and second gripping members do not interfere with the operation of the suction cup member and vice versa.

The transport unit of the filling machine may be movable in a reciprocating manner between the first and second end position by means of a linear actuator comprising a servomotor. Hereby high speed movement with precise position accuracy may be ensured. Also, the use of a servomotor facilitates operation under hygienic conditions.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DESCRIPTION OF EMBODIMENTS

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

The present invention relates to a filling machine for filling of flexible pouch type packages.

The packages may be provided as pre-made packages adapted to be filled and sealed in the filling machine. Alternatively, the packages may be produced fully or in part in the filling machine.

The packages are especially intended for products in the form of liquid foodstuffs such as dairy products, such as milk, water, fruit drinks, juice or wine.

The packages may be of any desirable volume.

Each package comprises a filling channel through which the package may be filled with the product. In case the package constitutes a pre-made package, the filling channel may be sealed by an end seal which has to be removed prior to filling.

Each package may in its simplest form comprise two flexible, opposing walls also referred to as a pillow pouch type package. However, other designs are feasible and the package may for instance comprise three flexible walls, two of which constitute opposing side walls; and the third constitutes a bottom wall, i.e. a package of stand-up pouch type.

The walls may be joined along a connecting portion to define a product compartment. The walls are made of a bendable and flexible material, which means that the volume of the product compartment depends on the relative distance between the walls. The volume of the product compartment is thus directly dependent on the filling ratio of the package. In other words, the package is of a collapsible type, also referred to as a pouch type package.

The walls of the package are preferably joined in the connecting portion by welding. Also other methods of joining, such as gluing, are conceivable.

The packages may be made from a web of flexible packaging material which may be a multilayered film material. The film material may comprise a core layer of mineral-based filler and a binder of polyolefin. It will be appreciated that also other materials and layers are possible, such a gas barrier layer or a light barrier layer. The film material may also be a transparent packaging material, i.e. each of the layers making up the material is transparent.

For conversion of the web of packaging material into packages, the web may be folded in the shape of an M and subsequently be subjected to a sealing operation in order to provide a web of interconnected packages. The web may be wound up on a roll to be supplied to the filling machine where the packages constitute pre-made packages, i.e. are used as blanks to be filled with contents.

Figure 1:
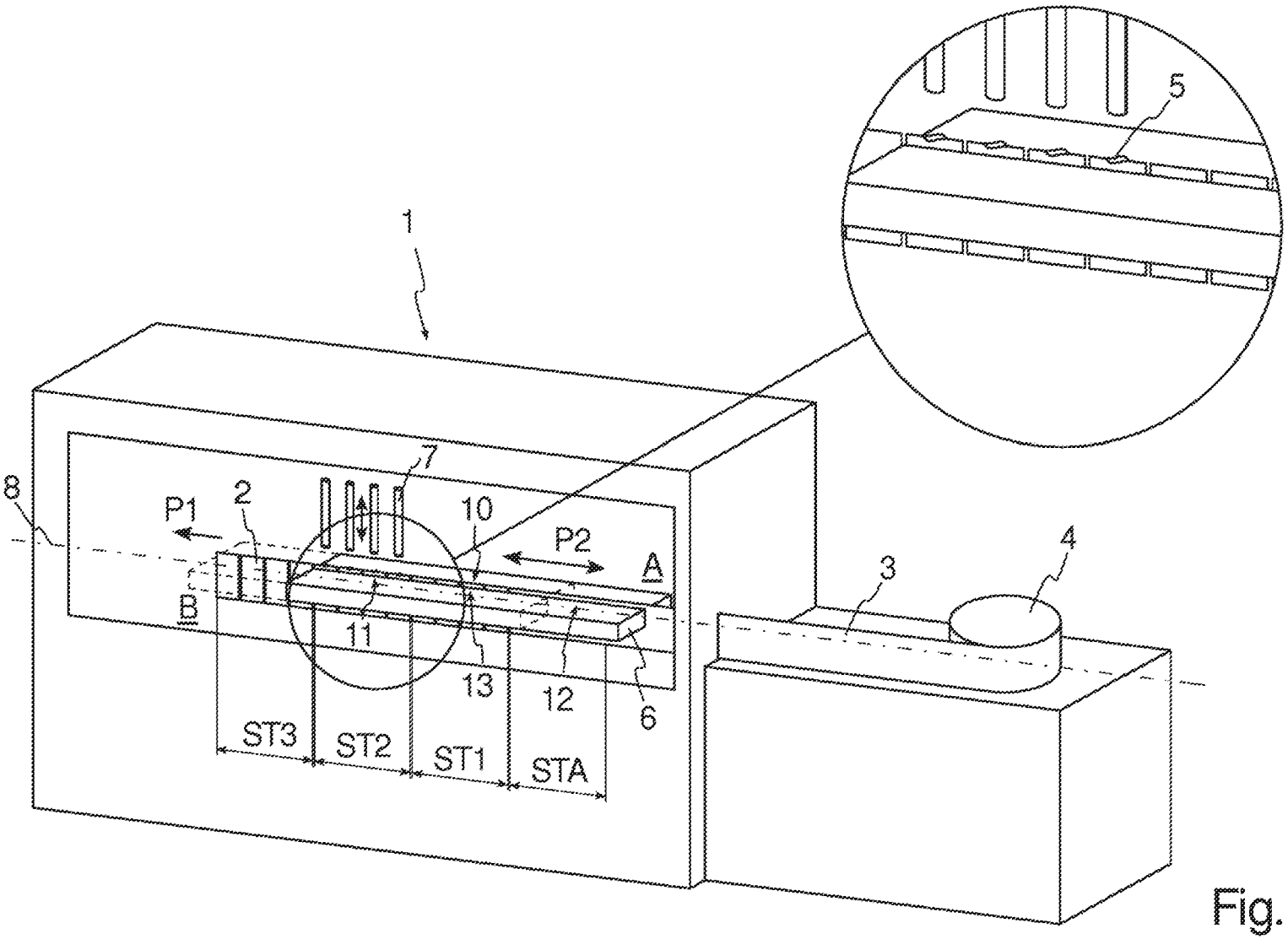
FIG. 1 is a schematic perspective view of a filling machine in accordance with the present invention.

In FIG. 1, to which reference now is made, a filling machine 1 in accordance with the present invention is schematically illustrated.

The filling machine 1 may as in the shown example be arranged for filling of flexible pouch type packages 2 provided in an interconnected state forming a web 3 wounded up on a roll 4. Each package 2 comprises a filling channel 5 which has to be opened-up in order for the package to be filled with product. The filling channel 5 is clearly seen in an opened-up state in the enlarged part view shown in FIG. 1.

The packages 2 are essentially flat before filling, i.e. in a non-filled state of the packages.

The filling machine 1 in accordance with the present invention comprises a filling station ST2 and also an upstream station ST1 located upstream of the filling station ST2 and a downstream station ST3 located downstream of the filling station ST2.

There may be additional upstream and downstream stations.

The upstream station ST1 may for instance constitute an input station or a separation station in which individual packages 2 may be separated from the web 3 of interconnected packages. Other types of upstream stations are of course also conceivable.

The downstream station ST3 may for instance constitute a sealing station or an output station from which the packages 2 may be outputted, for instance transferred to an output conveyor belt. Other types of downstream stations are of course also conceivable.

The filling machine 1 shown in FIG. 1 comprises an upstream station ST1 in the form of a separation station, a filling station ST2 and a downstream station ST3 in the form of an output station. The illustrated filling machine 1 further comprises an additional upstream station STA located upstream of the upstream station ST1, which additional upstream station STA constitutes an input station.

The filling machine 1 according to the present invention further comprises a transport unit 6 for feeding the packages 2 through the filling machine 1. More specifically, the transport unit 6 is arranged for intermittent, edgewise advancement of the packages in a feeding direction P1.

That the transport unit 6 is arranged for "edgewise advancement" of the packages 2 means that the transport unit 6 is arranged to advance the packages in a direction coinciding with the plane in which each package in an essentially flat, non-filled state extends.

The transport unit 6 is arranged for edgewise, intermittent advancement of the packages 2 in the feeding direction P1 from the upstream station ST1 to the downstream station ST3 via the filling station ST2. If additional upstream and/or downstream stations are present, the transport unit may also be arranged to cover also these additional stations. Thus, in the filling machine 1 shown in FIG. 1, the transport unit 6 is arranged for advancement of the packages 2 from the additional upstream station STA to the upstream station ST1, from the upstream station ST1 to the filling station ST2 and from the filling station ST2 to the downstream station ST3.

The filling station ST2 of the filling machine 1 shown in FIG. 1 comprises four filling pipes 7 connected to a not shown source of product. Thus, the transport unit 6 is in this case arranged for handling of packages 2 in groups of four. When a group of four packages 2 arrive to and are held stationary at the filling station ST2, each filling pipe 7 may be inserted into the respective filling channel 5 of the packages 2 in order for the packages 2 to be filled with the product.

In the embodiment shown in FIG. 1, the downstream station ST3 constitutes an output station and thus the filling station ST2 may in this case comprise a sealing member (not shown) arranged for sealing of the filled packages 2. Alternatively, a sealing member may be integrated in the transport unit for sealing the packages during movement from the filling station to the downstream station, or a sealing member may be arranged at the downstream station.

The transport unit 6 is movable along a longitudinal axis 8 parallel with the feeding direction P1 in a reciprocating manner indicated by double arrow P2 between a first end position A and a second end position B (indicated by dotted lines). A drive unit (not shown) is provided for the movement of the transport unit 6.

The transport unit 6 comprises a first gripping member 10 for the advancement of the packages 2 from the upstream station ST1 to the filling station ST2. More specifically, the first gripping member 10 is arranged to retrieve one or more packages 2 from the upstream station ST1 when the transport unit 6 is in the first end position A; and to deliver the one or more packages 2 to the filling station ST2 when the transport unit 6 is in the second end position B. The packages 2 retrieved by the first gripping member 10 is empty, i.e. in the non-filled state. In the shown embodiment, the upstream station ST1 constitutes a separation station for separating individual packages 2 from the web 3 of interconnected packages, and first gripping member 10 is thus arranged for retrieving the packages 2 in a separated state.

The transport unit 6 further comprises a second gripping 11 member for the advancement of the packages from the filling station ST2 to the downstream station ST3. More specifically, the second gripping member 11 is arranged to retrieve one or more packages 2 from the filling station ST2 when the transport unit 6 is in the first end position A; and to deliver the one or more packages 2 to the downstream station ST3 when the transport unit 6 is in the second end position B. The packages 2 retrieved by the second gripping member 11 is filled, i.e. in a filled state.

As shown in FIG. 1, the transport unit 6 may also comprise an additional gripping member 12 for advancement of the packages 2 from the additional upstream station STA to the upstream station ST1. More specifically, the additional gripping member 12 is arranged to retrieve one or more packages 2 from the additional upstream station STA constituting an input station when the transport unit 6 is in the first end position A; and to deliver the one or more packages 2 to the upstream station ST1 when the transport unit 6 is in the second end position B. The packages 2 retrieved from the additional upstream station STA are in an interconnected state forming part of the web 3 and, thus, when the transport unit 6 is moved from the first end position A to the second end position B, the roll 4 upon which the web 3 of interconnected packages is wound up, will be unwound and a new group of packages 2 will be advanced to the additional upstream station STA replacing those retrieved by the additional gripping member 12 of the transport unit 6.

The packages 2 are held at the respective stations by means of stationary grippers (not shown). All gripping members 10, 11, 12 of the transport unit are arranged to cooperate with the stationary grippers arranged at the different station in order for the packages to be handed over from the stationary grippers to the gripping members and vice versa.

Thus, when the transport unit 6 is in the first end position A, a first stationary gripper may be arranged to hand over packages 2 held at the upstream station ST1 to the first gripper member 10 of the transport unit 6; and a second stationary gripper may be arranged to hand over packages 2 held at the filling station ST2 to the second gripping member 11 of the transport unit 6. If the filling machine 1, as in the example shown in FIG. 1, comprises an additional upstream station STA, an additional stationary gripper may be arranged to hand over packages 2 held at the additional upstream station STA to the additional gripping member 12 when the transport unit 6 is in the first end position A.

Correspondingly, when the transport unit 6 is in the second end position B, the first gripping member 10 of the transport unit 6 may be arranged to hand over packages advanced by the transport unit 6 to the second stationary gripper arranged at the filling station ST2; and the second gripping member 11 of the transport unit 6 may be arranged to hand over packages 2 advanced by the transport unit 6 to a third stationary gripper arranged at the downstream station ST3. If the filling machine 1, as in the example shown in FIG. 1, comprises an additional upstream station STA, the additional gripping member 12 of the transport unit 6 may be arranged to hand over packages advanced by the transport unit 6 to the first stationary grippers arranged at the upstream station ST1 when the transport unit 6 is in the second end position B.

As mentioned above, the transport unit 6 of the filling machine 1 shown in FIG. 1 is arranged for handling of packages 2 in groups of four. Thus, each of the gripping members 10, 11, 12 and of the stationary grippers is in this case arranged for parallel handling of four packages. The transport unit 6 may naturally be arranged for handling of packages in groups of a different number. A group may consist of 2-6 packages.

The transport unit 6 further comprises a suction cup member 13 arranged for opening-up of the filling channel 5 of each the one or more of the packages 2 in the non-filled state retrieved by the first gripping member 10 while the transport unit 6 is moved from the first end position A to the second end position B. The suction cup member 13 will be described more in detail below.

Thus, when the packages 2 are delivered to the filling station ST2, the filling channel 5 of each package 2 is already opened-up, and the filling pipes 7 of the filling station ST2 may immediately be inserted into the filling channels 5 for filling of the packages 2. The filling pipes may be inserted into the packages by means of a relative motion between the filling pipes and the packages.

Figure 2:
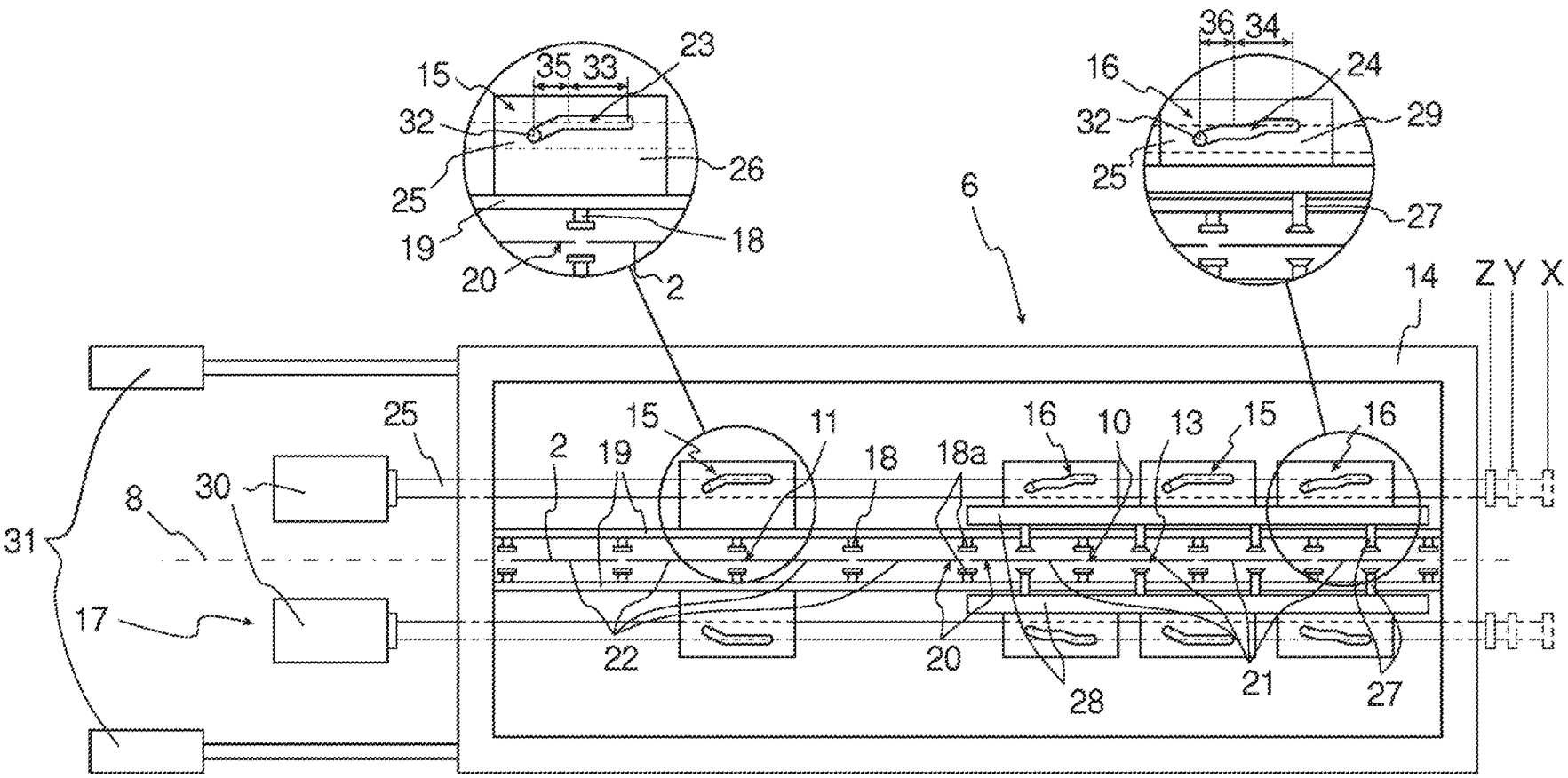
FIG. 2 is a schematic plan view of a transport unit for a filling machine in accordance with the present invention.

In FIG. 2, to which reference now is made, a transport unit 6 for a filling machine 1 according to the present invention is schematically shown.

The transport unit 6 comprises a frame 14 supporting a first 10 and a second 11 gripping member; and a suction cup member 13. The transport unit 6 is displaceable in a reciprocating manner along the longitudinal axis 8 parallel with the feeding direction of the filling machine by means of a drive unit 31 coupled to the frame 14. The drive unit 31 may comprise a single linear actuator, or as in the shown example two synchronized linear actuators.

The first and second gripping members 10, 11 are associated with a first cam unit 15 which is linked to a cam driver 17 which is displaceable along an axis parallel with the feeding direction P1 of the filling machine 1. The operation of the gripping members 10, 11 is controlled by displacement of the cam driver 17.

The suction cup member 13 is associated with a second cam unit 16 which is linked to the cam driver 17, and the operation of the suction cup member 13 is controlled by displacement of the cam driver 17.

The gripping members 10, 11 may comprise pairs of opposing projections 18 movable towards each other in order to grip the packages 2.

As illustrated in FIG. 2, the pairs of opposing projections 18 may be supported by a first pair of bars 19 extending in parallel at a distance from each other. A first group of the pairs of the opposing projections 18 forms the first gripping member 10 and a second group of the opposing projections 18 forms the second gripping member 11.

When moved towards each other, the projections 18 may be arranged to engage with the side edge portions 20 of the packages 2 such that each pair of opposing projections 18 grips a rear side edge portion 20 of one package 2 and a front side edge portion 20 of an adjacent package 2. Thus, the pair of opposing projections 18*a* gripping the last package 2 of a first group 21 of packages and the first package 2 of a second group 22 of packages may form part of both the first gripping member 10 and the second gripping member 11.

As mentioned above, the first cam unit 15 is associated with the first and second gripping member 10, 11.

The first cam unit 15 may comprise a first cam curve 23; and the cam driver 17 may comprise an axially displaceable piston 25 linked to the first cam curve 23.

The first cam curve 23 of the first cam unit 15 may be provided in a plate 26 fixed to the first and second gripping members 10, 11.

The first cam unit 15 may be arranged to cause the gripping members to grip the packages between one movable and one stationary part or between two movable parts.

In the embodiment shown in FIG. 2, the first cam unit 15 is arranged to cause the first and second gripping members 10, 11 to grip the packages 2 between two movable parts. The first cam unit 15 comprises four plates 26 each provided with the first cam curve 23 in the form of a groove formed in the plate 26. Two plates 26 are attached at a distance from each other to one bar included in the first pair of bars 19, and the remaining two plates 26 are attached at a distance from each other to the other bar included in the first pair of bars 19.

The suction cup member 13 may comprise for each package 2 retrievable by the first gripping member 10 a pair of oppositely arranged suction cups 27 which are laterally movably arranged in order to engage and separate side wall sections defining the filling channel 5 of the associated package 2.

As illustrated in FIG. 2, the pairs of opposing suction cups 27 may be supported by a second pair of bars 28 extending in parallel at a distance from each other.

As mentioned above, the second cam unit 16 is associated with the suction cup member 13.

The second cam unit may comprise a second cam curve 24; and the cam driver 17 may comprise an axially displaceable piston 25 linked to the second cam curve 24 of the second cam unit 16.

The second cam curve 24 of the second cam unit 16 may be provided in a plate 29 fixed to the suction cup member 13.

The second cam unit 16 may be arranged to cause the suction cup member to engage the side wall portions of a package defining the filling channel between one movable and one stationary part or between two movable parts.

In the embodiment shown in FIG. 2, the second cam unit 16 is arranged to cause the suction cup member 13 to engage the package 2 between two movable parts. The second cam unit 16 comprises four plates 16 each provided with the second cam curve 24 in the form of a groove formed in the plate 29. Two of the plates 29 are attached at a distance from each other to one bar included in the second pair of bars 28, and the remaining two plates 29 are attached at a distance from each other to the other bar included in the second pair of bars 28.

In the shown embodiment, the cam driver 17 comprises two pistons 25 which are movable in unison along the longitudinal axis 8 by means a drive unit 30. The drive unit 30 may comprise one linear actuator or as in the shown example two synchronized linear actuators.

The cam driver is displaceable in parallel with the longitudinal axis 8 between a first cam end position X, an intermediate cam position Y and a second cam end position Z.

Each piston 25 supports four protrusions 32, two of which are received by the first cam curves 23 of the first cam unit 15 and two of which are received by the second cam curves 24 of the second cam unit 16. The protrusions 32 thus act as cam followers and an axial displacement of the cam driver 17, i.e. unison movement of the two pistons 25, will dependent on the respective cam curve 23, 24 cause a lateral movement of the first cam unit 15 and of the second cam unit 16, and thus also of first and second gripping member 10, 11 associated to the first cam unit 15 and of the suction cup member 13 associated to the second cam unit 16. A single cam driver 17 is thus used for operation of both the first and second gripping members and of the suction cup member.

The function of the transport unit 6 of the filling machine 1 according to the invention will now be described more in detail with reference to FIGS. 3*a-e* schematically illustrating a transport unit 6 of the type shown in FIG. 2.

Figure 3A:
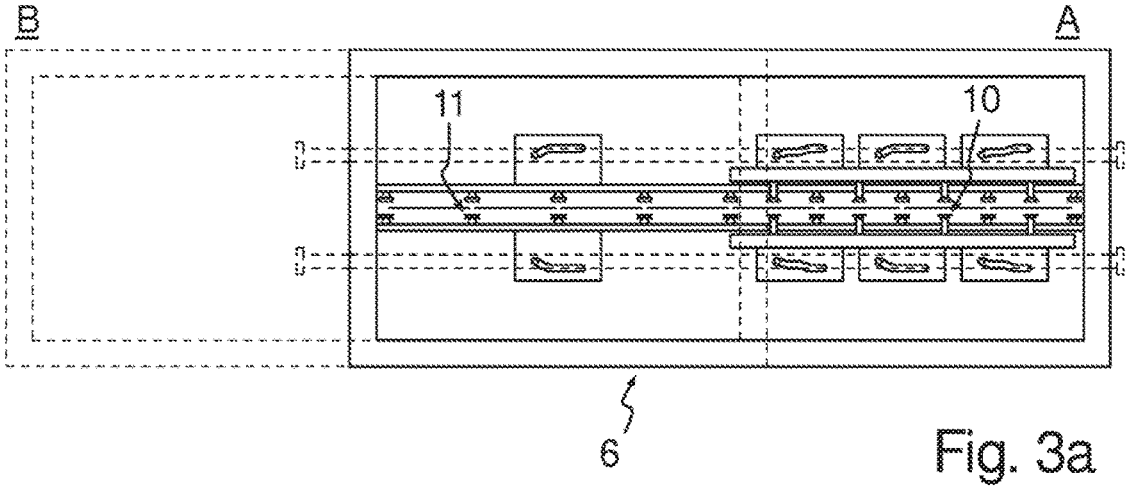
FIGS. 3*a-e* are schematic plan views illustrating the operation of the transport unit shown in FIG. 2.

In FIG. 3*a*, the transport unit 6 is in the first end position A. The first and second gripping members 10, 11 are in a separated position and the first gripping member 10 is prepared to grip a first group of packages 21 and the second gripping member 11 is prepared to grip a second group of packages 22. The groups of packages correspond to those groups of packages indicated in FIG. 2. The first gripping member 10 may thus be prepared to grip a first group of four non-filled packages located at the upstream station and held by a first stationary gripper and the second gripping member may be prepared to grip a second group of four filled packages located at the filling station and held by a second stationary gripper.

Figure 3B:
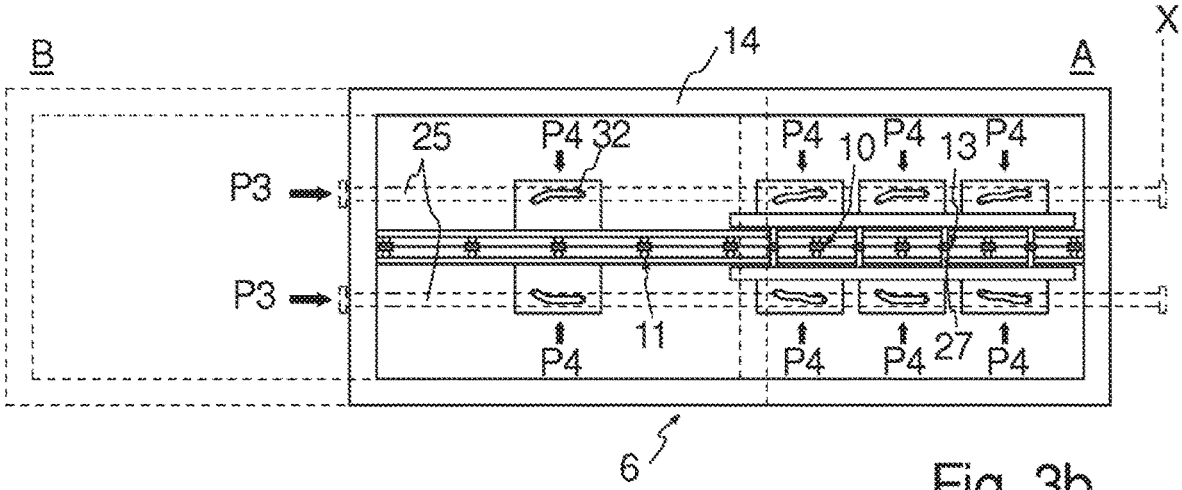

In FIG. 3*b*, the cam driver (not shown) has been activated and the two pistons 25 has thus been displaced in a direction indicated by arrows P3 to a first cam end position X relative to the frame 14. The protrusions 32 supported by the pistons 25 will thereby transfer the longitudinal movement of the pistons 25 to a lateral movement indicated by arrows P4 of the first and second gripping members 10, 11 and of the suction cup member 13. Thus, the first gripping member 10 will grip the first group 21 of packages and the second gripping member 11 will grip the second group 22 of packages. At the same time the pairs of suction cups 27 will engage the side wall portions defining the filling channels of the first group 21 of packages retrieved by the first gripping member 10, i.e. the packages that may be located at the upstream station of the filling machine. When the first and second gripping members 10, 11 have gripped the packages 2, the stationary grippers may release their grip of the packages such that the packages 2 are handed over to and retrieved by the transport unit 6.

Figure 3C:
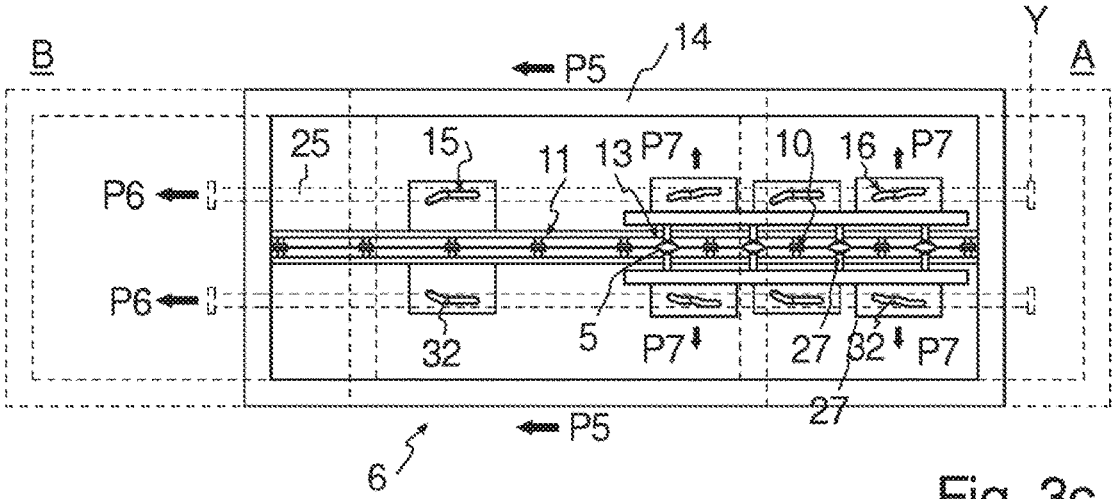

In FIG. 3*c* the transport unit is being moved in the direction indicated by arrow P5 by a not shown drive unit from the first end position A indicated by dotted lines to the second end position B also indicated by dotted lines. The cam driver has also been activated by displacement of the pistons 25 in the direction indicted by arrows P6 from the first cam end position X to an intermediate cam position Y. The first cam unit 15 is so arranged that no lateral movement of the first and second gripping members 10, 11 is caused in response to this displacement of the pistons 25. More specifically, each first cam curve 23 of the first cam unit 15 comprise a straight section 33 shown in FIG. 2 extending in parallel with the direction P6 in which the pistons 25 are moved and thus the protrusions 32 received by the first cam curves 23 of the first cam unit 15 will not impart any lateral movement of the first cam unit 15 and the first and second gripping members 10, 11 associated thereto, which means that the first and second gripping members 10, 11 will maintain their grip of the first and second groups 21, 22 of packages. The second cam unit 16 however is so arranged that lateral movement of the suction cup member 13 is caused in response to the displacement of the pistons 25. More specifically, each second cam curve 24 of the second cam unit 16 comprise a first curved section 34 (also indicated in FIG. 2) and the protrusions 32 received by the second cam curves 24 of the second cam unit 16 will thus follow these first curved sections 34 in response to the displacement of the pistons 25 and impart lateral movement in the direction indicated by arrows P7 of the second cam unit 16 and of the suction cup member 13 associated thereto, which means that the pairs of opposing suction cups 27 will be separated and as a consequence the filling channels 5 of the first group 21 of packages will be opened-up.

Figure 3D:
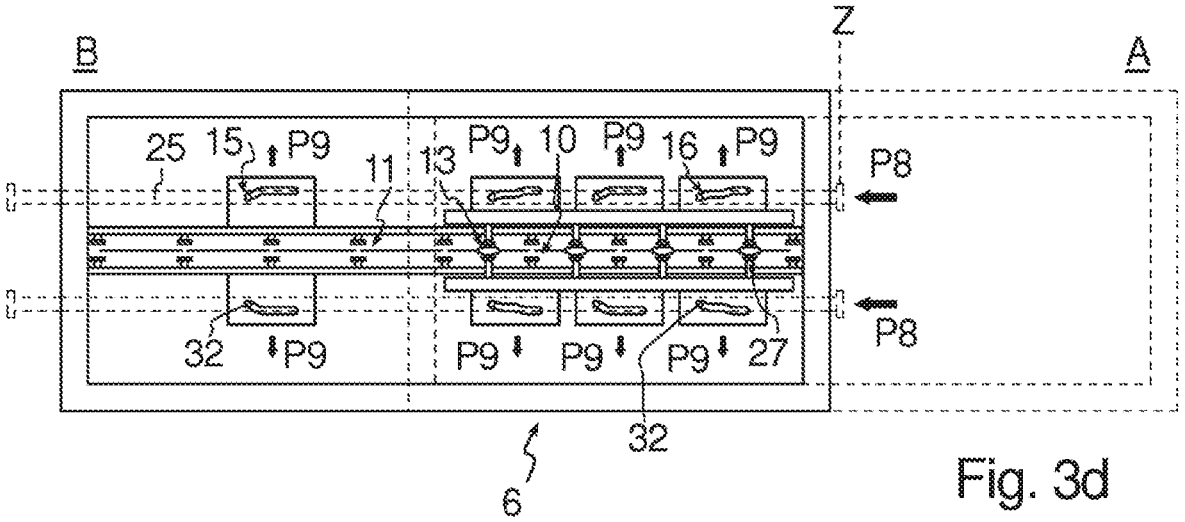

In FIG. 3*d*, the transport unit 6 is in the second end position B. The cam driver has also been activated by displacement of the pistons 25 in the direction indicted by arrows P8 from the intermediate cam position Y to a second cam end position Z. The first and second cam units 15, 16 are so arranged that lateral movement of the first and second gripping members 10, 11 and of the suction cup member 13 is caused in response to the displacement of the pistons 25 from the intermediate cam position Y to the second cam end position Z such that the first and second gripping members 10, 11 release their grip of the first and second groups 21, 22 of packages and pairs of opposing suction cups 27 of the suction cup member 13 are further separated and disengage from the first group of packages 21. Thus, the first group 21 of packages may be handed over to stationary grippers arranged at the filling station and filling pipes may be inserted into the opened-up filling channels; and the second group 22 of packages may be handed over to stationary grippers arranged at the downstream station.

More specifically, each first cam curve 23 of the first cam unit 15 comprises a curved section 35 (shown in FIG. 2) and thus the protrusions 32 received by the first cam curves 23 of the first cam unit 15 will in response of movement of the cam driver 17 from the intermediate cam position Y to the second cam end position Z impart lateral movement in the directions indicated by arrows P9 of the first cam unit 15 and of the first and second gripping members 10, 11 associated thereto, which means that the first and second gripping members 10, 11 will release their grip of the first and second groups 21, 22 of packages. Each second cam curve 24 of the second cam unit 16 comprise a second curved section 36 (shown in FIG. 2) and the protrusions 32 received by the second cam curves 34 of the second cam unit 16 will thus follow these second curved sections 36 in response to the displacement of the pistons 25 from the intermediate cam position Y to the second cam end position Z and impart lateral movement in the direction indicated by arrows P9 of the second cam unit 15 and of the suction cup member 13 associated thereto, which means that the pairs of opposing suction cups 27 will be further separated and as a consequence the pairs of opposing suction cups 27 will disengage the first group 21 of packages.

Figure 3E:
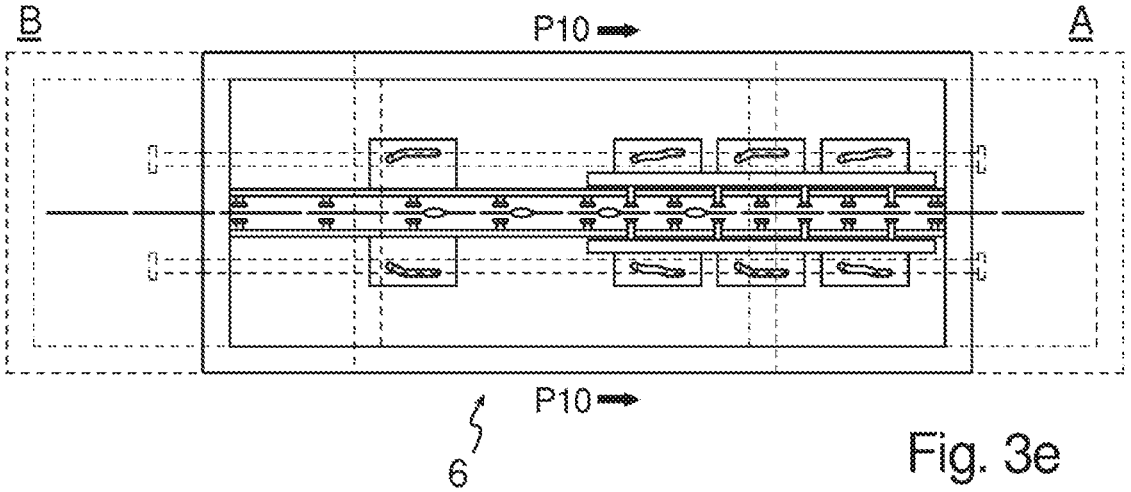

In FIG. 3*e*, the transport unit 6 is being moved in the direction indicated by arrow P10 from the second end position B to the first end position A in order to repeat the cycle of retrieving and delivering packages 2. As shown in the FIG. 3*e*, a new group of packages has been fed forward for retrieval by the transport unit 6.

As mentioned above, the cam driver 17 is displaceable between the first cam end position X and the second cam end position Y by means of a drive unit 30. The drive unit 30 for the cam driver 17 may be a hydraulic, pneumatic, mechanical or electric linear actuator. The drive unit 30 may be a linear actuator comprising a servomotor and sensors may be arranged for provision of position feedback to a unit controlling the servomotor. The use of a servomotor enables operation of the first and second gripping members and of the suction cup member under hygienic conditions while ensuring precise control over speed and position. Thus, the filling machine may be operated under hygienic conditions at high speed.

As mentioned above, the transport unit 6 is displaceable between the first end position A and the second end position B by means of a drive unit 31. The drive unit 31 for the transport unit 6 may be a hydraulic, pneumatic, mechanical or electric linear actuator. The drive unit 31 may be a linear actuator comprising a servomotor and sensors may be arranged for provision of position feedback to unit controlling the servomotor. The use of a servomotor enables movement of the transport unit under hygienic conditions while ensuring precise control over speed and position. Thus, the filling machine may be operated under hygienic conditions at high speed.

Figure 4:
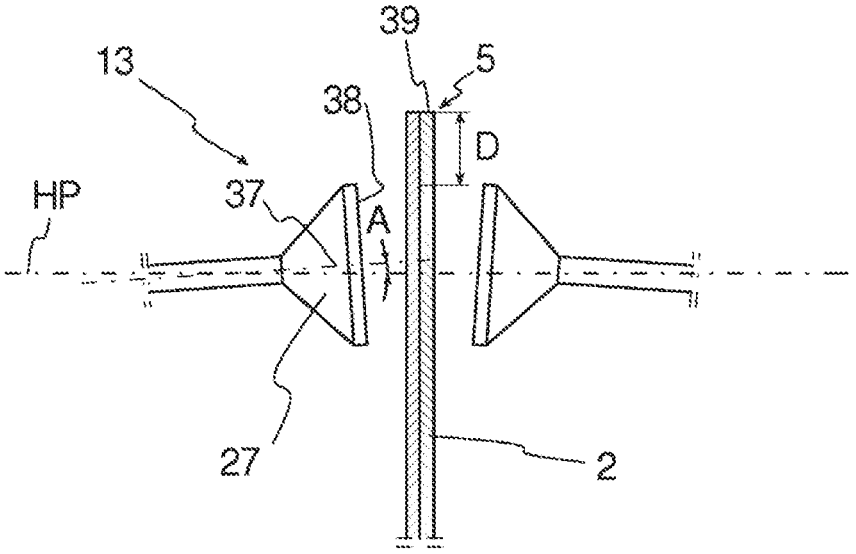
FIG. 4 is a schematic side view of a configuration of a pair of opposing suction cups of a suction cup member for a transport unit in accordance with the present invention.

As mentioned above, the suction cup member 13 comprises pairs of opposing suction cups 27. The suction cups of the suction cup member may be arranged in a non-tilted manner. Alternatively, as illustrated in FIG. 4, a suction cup 27 included in such a pair of opposing suction cups may have an axis 37 being tilted with an angle A in the range of 1-10 degrees relative a horizontal plane HP. The axis 37 of the suction cup 27 may be tilted such that an engagement surface 38 of the suction cup is faced obliquely upward. As a result, the filling channel 5 of the package 2 may be more easily opened-up in response to separation of the opposing suction cups 27.

Each pair of suction cups may be arranged to engage a top edge portion of the package. Alternatively, each pair of opposing suction cups may be arranged to engage the associated package at a distance D from a top edge 39 of the package 2, which also is illustrated in FIG. 4. The distance D may be in the range of 2-10 mm. Hereby, the top edge 39 and adjacent portion of each package 2 is easily accessible for instance by clamping jaws during filling and by sealing jaws during sealing.

The first and second gripping members on the one hand and the suction cup member on the other hand may be arranged at different levels. Thus the movements of the first and gripping members may occur in a plane separated from the plane in which the suction cup members move. Hereby interference between gripping members and the suction cup member may be avoided.

It will be appreciated that the present invention is not limited to the embodiments shown. Several modifications and variations are thus conceivable within the scope of the invention which thus is exclusively defined by the appended claims.

The invention claimed is:

1. A filling machine for filling flexible pouch type packages each having a filling channel and being essentially flat in a non-filled state of the package, the filling machine comprising a transport unit arranged for intermittent, edgewise advancement of the packages in a feeding direction from an upstream station to a downstream station via a filling station, the transport unit being movable along an axis parallel with the feeding direction in a reciprocating manner between a first end position A and a second end position B, the transport unit comprising a first gripping member which, when the transport unit is in the first end position A, is arranged to retrieve one or more of the packages in a non-filled state from the upstream station and which, when the transport unit is in the second end position B, is arranged to deliver the one or more of the packages in the non-filled state to the filling station, the transport unit comprising a second gripping member which, when the transport unit is in the first end position A, is arranged to retrieve one or more of the packages in a filled state from the filling station and which, when the transport unit is in the second end position B, is arranged to deliver the one or more of the packages in the filled state to the downstream station, the transport unit comprising a suction cup member arranged for opening-up of the filling channel of the one or more of the packages in the non-filled state retrieved by the first gripping member while the transport unit is moved from the first end position A to the second end position, and a cam arrangement comprising a first cam unit associated with the first and second gripping members, a second cam unit associated with the suction cup member, and a cam driver which is displaceable along a longitudinal axis parallel with the feeding direction, wherein the operation of the first and second gripping members as well as of the suction cup member is controlled by displacement of the cam driver along the longitudinal axis, and wherein the suction cup member for each package retrieved by the first gripping member comprises a pair of oppositely arranged suction cups which are movably arranged in order to engage and separate side wall sections defining the filling channel of the associated package.

2. The filling machine according to claim 1, wherein each suction cup has an axis being tilted with an angle A in the range of 2-10 degrees relative a horizontal plane HP.

3. The filling machine according to claim 2, wherein the axis of each suction cup is tilted such that an engagement surface of the suction cup is faced obliquely upward.

4. The filling machine according to claim 1, wherein the cam driver is displaceable by means of linear actuator comprising a servomotor.

5. The filling machine according to claim 1, wherein each of the first and second gripping member is arranged for parallel handling of a group of packages consisting of 3-6 packages.

6. The filling machine according to claim 1, wherein the suction cups of the suction cup member are arranged to engage the one or more packages at a distance D in the range of 2-10 mm from a top edge of the packages.

7. The filling machine according to claim 1, wherein the first and second gripping members are arranged at a level separated from a level at which the suction cup member is arranged.

8. The filling machine according to claim 1, wherein the transport unit movable in a reciprocating manner between the first A and second B end position by means of a linear actuator comprising a servomotor.

* * * * *